US005816333A

United States Patent [19]

Audic et al.

[11] Patent Number: 5,816,333

[45] Date of Patent: Oct. 6, 1998

[54] FLAME BARRIER DEVICE

[75] Inventors: Bernard Audic, Clamart; Gerald Marcy, L'Hay-les-Roses, both of France

[73] Assignee: Schlumberger Industries, S.A., Montrouge, France

[21] Appl. No.: 732,508

[22] PCT Filed: May 16, 1995

[86] PCT No.: PCT/FR95/00631

§ 371 Date: Nov. 12, 1996

§ 102(e) Date: Nov. 12, 1996

[87] PCT Pub. No.: WO95/32024

PCT Pub. Date: Nov. 30, 1995

[30] Foreign Application Priority Data

May 25, 1994 [FR] France ..... 94 06436

[51] Int. Cl.[6] ..... A62C 4/00

[52] U.S. Cl. ..... 169/48; 222/189.01

[58] Field of Search ..... 169/45, 48, 54; 48/192; 431/346; 220/88.2; 222/189.01; 60/39.11; 128/202.24; 138/41, 42

[56] References Cited

U.S. PATENT DOCUMENTS 5,415,233 5/1995 Roussakis et al. ..... 169/48

*Primary Examiner*—Andrew C. Pike

*Attorney, Agent, or Firm*—Frishauf, Holtz, Goodman, Langer & Chick, P.C.

[57] ABSTRACT

A flame-barrier device has a plurality of openings that are essentially parallel relative to a flow of substance passing therethrough, the device being made up of an assembly of a plurality of pierced disks whose openings co-operate with adjacent corresponding openings to form through channels.

12 Claims, 2 Drawing Sheets

FLAME BARRIER DEVICE

The present invention relates to a flame-barrier device that is intended to prevent flames propagating or to prevent an explosion front propagating at a determined location.

1. Field of the Invention

More precisely, the invention relates more particularly to such a device suitable for being installed in pipes that serve to convey a gaseous substance or a mixture of such substances that are flammable or explosive.

2. Background of the Invention

In systems for recovering hydrocarbon vapor, e.g., those relating to dispensing gasoline, there is a requirement that flame barriers shall be inserted in ducts that convey an explosive mixture of air and gaseous hydrocarbons in order to prevent propagation of flames or of an explosion front. Flames, and worse, an explosion can be created in such a gasoline pump by other apparatuses requiring mechanical or electrical power for their operation. This applies in particular to the pumps proper where parts in relative motion can give off sparks by shock. Similarly, a source of heat can give rise to deflagration of said explosive gaseous mixture which it is important to confine in space and prevent from propagating.

In such flame barriers, it is desired to produce a flame-throttling effect by causing the incandescent gases to pass through a plurality of small-diameter ducts that are long relative to their diameter and that are made of materials having high thermal conductivity, high specific heat, and a large heat exchange area. That leads immediately to a drop in the temperature of the gas and stops propagation. In all cases it is desirable to make holes that are long and small in diameter, which is very difficult to do using conventional techniques.

Such flame barriers are already known constituting some quantity of small-diameter metal tubes stacked together in a bundle and held together by welding or by adhesive. The set of individual tubes may be fixed inside a ring, with the assembled flame barrier being essentially round and symmetrical in shape, e.g., having the shape of a disk. Nevertheless such devices are expensive.

U.S. Pat. No. 4,484,690 discloses a flame-barrier device constituted by an assembly of several disks pierced by holes and spaced apart by spacers, with the openings through the disks being disposed in a staggered configuration.

United Kingdom patent No. 723 936 describes a flame-barrier device provided with a plurality of openings that are essentially parallel relative to a flow of substance passing therethrough, the device being constituted by an assembly comprising a plurality of pierced disks whose openings are in alignment. In that known device, the pierced disks are separated by disks or sheets of fine gauze.

Another known type of such a flame barrier consists in winding a previously corrugated tape onto a cylindrical central part. The turns of the winding are kept apart by winding them simultaneously with a flat tape. The spiral-wound corrugated tape whose turns are held apart by the flat tape forms a disk which is fixed inside a ring. The corrugations may be parallel to the central axis of the flame barrier, thereby providing passages parallel to the flow direction of the substance passing therethrough, or they may be at an inclination relative to the central axis.

As described, that method of obtaining such a flame barrier remains quite expensive and suffers from the severe drawback of giving rise to a device that can itself be deformed by the pressure wave of a deflagration or an explosion, tending to extrude the individual turns relative to one another by sliding.

SUMMARY OF THE INVENTION

The object of the present invention is thus to provide a flame-barrier device which is guaranteed to operate also under explosion conditions because of its stability and resistance to deformation, and which is nevertheless easy to manufacture and therefore cheaper.

To achieve this object, the invention provides a flame-barrier device provided with a plurality of openings that are essentially parallel relative to a flow of a substance passing through the device, the device being constituted by an assembly of a plurality of pierced disks whose openings are in alignment, and being remarkable in that pierced disks are stacked to form a bundle, and in that the openings of the disks come into alignment in such a manner as to co-operate with adjacent corresponding openings to form parallel through channels.

The advantage of a flame barrier of the invention is that it can be adapted easily to varying operating conditions relating to its durability, its specific heat, and its heat exchange surface area. In addition, the invention makes it possible to combine disks of different materials in order to adapt the flame barrier of the invention to the expected operating conditions. For this purpose, such a flame barrier is constituted by at least one metal disk and/or at least one ceramic disk, for example.

BRIEF DESCRIPTION OF THE DRAWINGS

Other characteristics and advantages of the invention appear from the dependent claims and also from the following description of various embodiments of the invention given as nonlimiting examples. The description refers to the accompanying figures, in which:

DETAILED DESCRIPTION OF THE PREFERRED EMBODIMENTS

Figure 1:
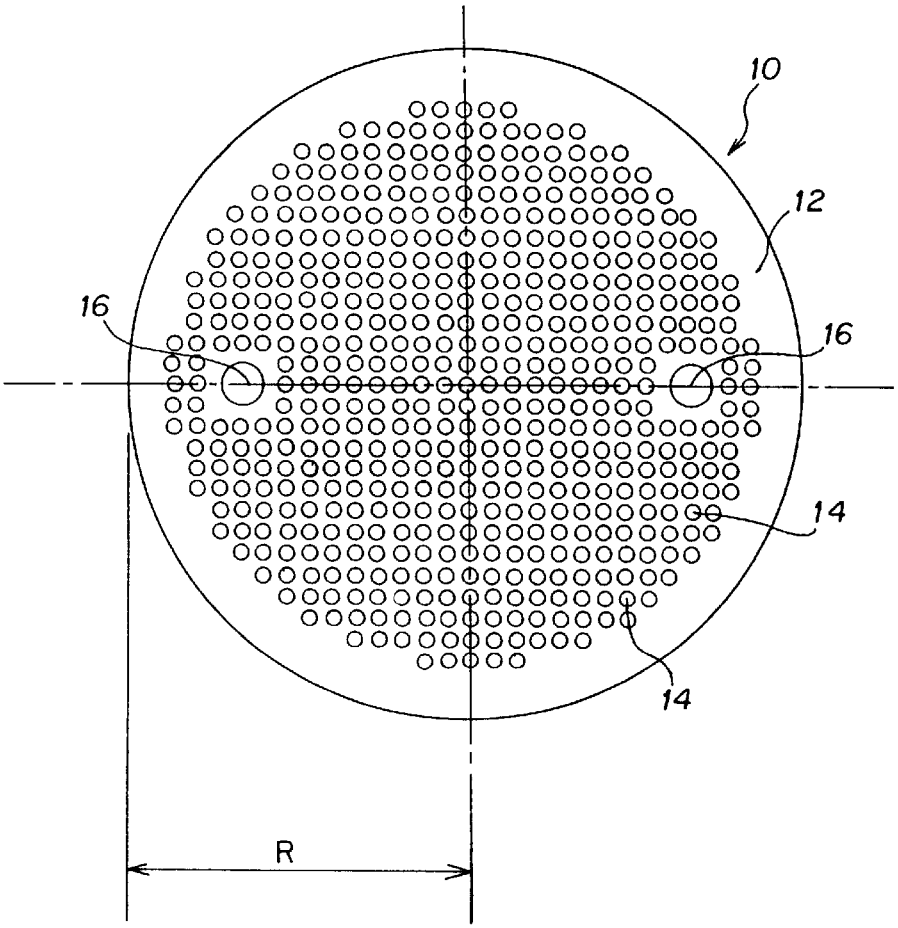
FIG. 1 is a plan view of a first embodiment of the flame-barrier device of the invention.

FIG. 1 shows a flame-barrier device 10 of which there can be seen a preferably metal disk 12 provided with a plurality of holes 14. The holes 14 are made by drilling, stamping, forging, punching, or molding. The holes 14 are preferably of identical diameter that is comparatively small relative to the diameter of the disk 12. The set of said holes 14 is to prevent flames or an explosion front from propagating; however it must also allow the flowing substance to pass through without impeding passage thereof. When the device is a flame barrier 10 for use in a system for recovering hydrocarbon vapor having disks 12 of a radius R of about . mm, it is preferable to make several hundreds of holes 14 each having a diameter of about 0.6 mm to 0.7 mm.

Figure 2:
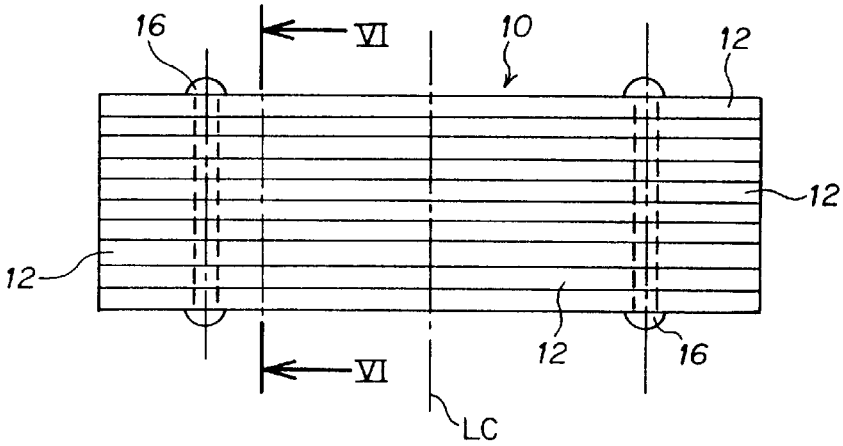
FIG. 2 is a side view of the FIG. 1 device.

As shown in FIG. 2, the flame-barrier device 10 is made up of a plurality of pierced disks 12 which are stacked together to form a bundle. In order to facilitate mounting the disks 12 so that the holes 14 come into alignment, thereby forming channels that are essentially parallel relative to the centerline LC, several reference marks are preferably placed on the disks 12. The easiest reference marks to make are holes of some reasonable diameter greater than that of the other holes 14 and likewise parallel to the centerline LC. By way of example, FIG. 1 shows two such reference marks that also serve to receive two rivets 16 (as can also be seen in FIG. 2) for fixing the disks 12 together.

Figure 3:
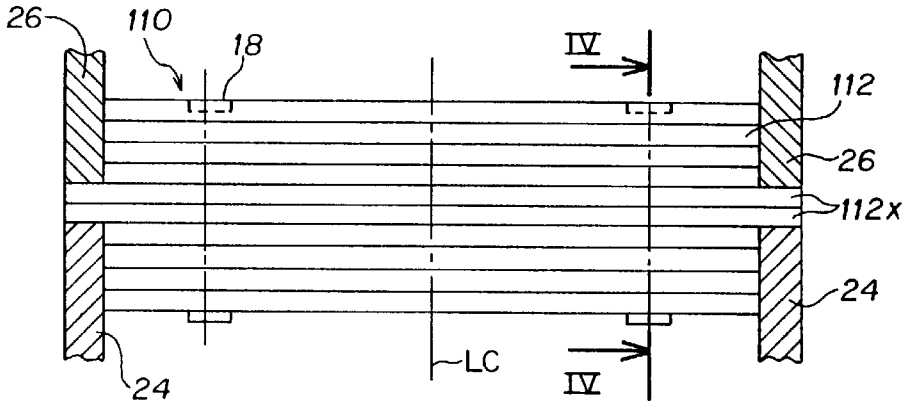
FIG. 3 is a side view of a second embodiment of the invention.
Figure 4:
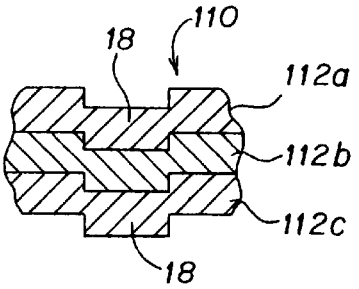
FIG. 4 is a section view on a larger scale showing a feature of the FIG. 3 device on the section line marked IV-IV in FIG. 3.

Another method of the invention consists in fixing disks 112 while attaching them to one another by means of studs 18 as shown in FIGS. 3 and 4. In particular, FIG. 4 shows how embossed studs 18 serve as reference marks for determining the position of one disk 112*a* relative to another disk 112*b* or 112*b* relative to 112*c*, for example, and also for the purpose of interfitting and making up the bundle that constitutes the flame-barrier device 110.

Figure 5:
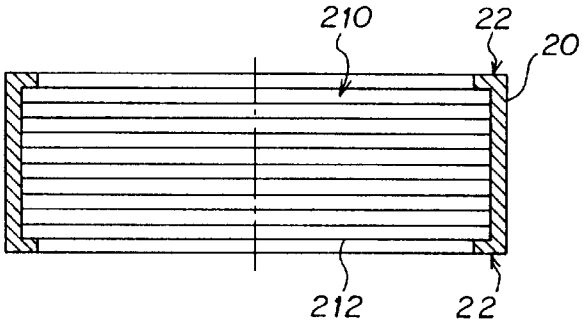
FIG. 5 is a side view of a third embodiment of the invention.

FIG. 5 shows a third way of fixing a plurality of disks 212 in a ring 20 so that the disks are stacked to constitute the flame-barrier device 210 of the invention. In this case there is a circle made of metal, for example, surrounding the periphery of the disk 212 with the edge portions 22 of the circle being placed so that they extend towards the centerline, encompassing and securing the disks 212. Although not visible in FIG. 5, the disks 212 clearly need to have reference marks as explained above.

All of the embodiments of the invention described so far are associated with flame-barrier devices each in the form of a fixed disk: its outer periphery is uniform, smooth, and even. Such flame barriers are typically used inside pipes where they are placed in shaped locations. However, it is also possible for a flame-barrier device of the invention to have a ring which serves not only for fixing the individual disks together but also includes remote edge portions 22 that act as sleeves, e.g., for interconnecting lengths of pipe. Under such circumstances, the flame barrier should be provided with at least one disk that is of greater diameter than the others.

In addition, another possibility for integrating the flame-barrier device 110 of the invention in a pipe system is shown in FIG. 3. In this example, two disks 112X located substantially in the middle of the flame barrier 110 have an outside diameter that is greater than that of the diameters of the other disks 112. The peripheral sections of the disks 112 adjacent to the disks 112X can thus serve as seats for two pipes 24 and 26. The flame barrier 110 also serves to interconnect the two pipes 24 and 26 without impeding its main function.

Figure 6:
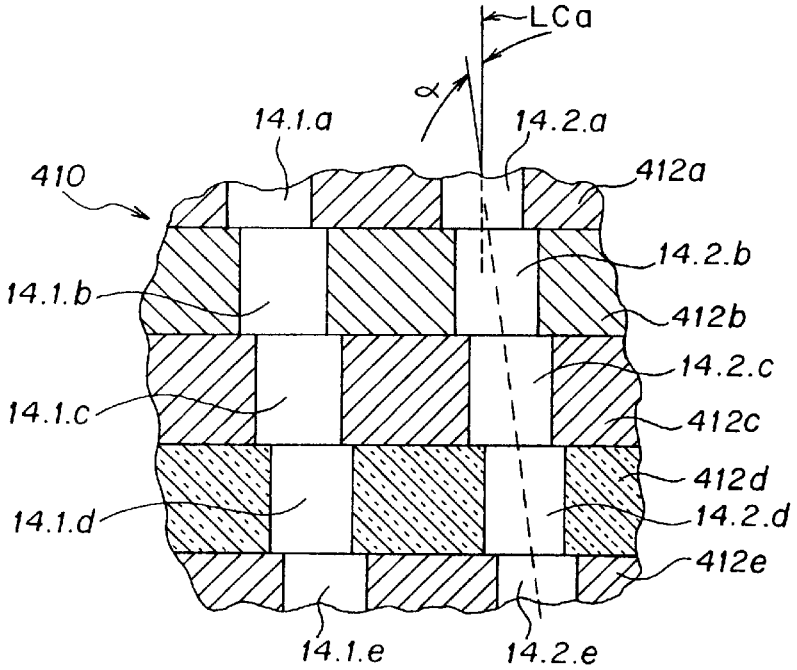
FIG. 6 is a section view of yet another embodiment which has the same side view as that of the FIG. 2 embodiment. For convenience, the section view for FIG. 6 is illustrated as being taken on the section line marked VI—VI in FIG. 2.

Finally, FIG. 6 shows another embodiment of the invention. In order to make FIG. 6 easier to draw and to concentrate on essential details only, FIG. 6 shows only five disks 412*a*, 412*b*, 412*c*, 412*d*, and 412*e* plus two series of adjacent holes 14.1*a–e* and 14.2*a–e* as examples of the assembly constituted by the flame barrier 10. In this case, the disks 412*a–e* are slightly offset relative to one another as are the holes 14.1*a–e* and 14.2*a–e*.

Consequently, the channel formed by the series of holes 14.1*a–e* is inclined slightly relative to line LCa which represents the centerline of the flame barrier 410, as indicated by angle α. For the main purpose of the flame barrier 410, the configuration of FIG. 6 gives the advantage that the speed of a flame front or of an explosion reaching the flame barrier is prevented from propagating along the same direction. The inclination relative to the flame propagation direction weakens the energy of the front in combination with the obstacles created by said steps formed by the edges of the holes 14.1*a–e* and 14.2*a–e* projecting into the channels.

Also, the increase in the internal surface area of each channel as created by offsetting the disks in this way assists the effect whereby flame (or explosion) energy is reduced by heat exchange.

To increase the specific heat of the flame barrier 410 of the invention, and as shown by way of example in FIG. 6, it is possible to include between the disks 412*c* and 412*e* a disk 412*d* of a nonmetallic material, preferably a ceramic. Without limiting the concept of the invention in any way, it is clear that it is possible to use a plurality of such disks that are ceramic or more generally nonmetallic.

From all of the embodiments of the present invention described above and that are roughly cylindrical in shape, it is easy to imagine building flame barriers of other shapes: e.g., rectangular, in order to fit them better to types of channel other than round channels.

In all cases, the advantage of a flame-barrier device of the invention consists firstly in its low cost price and secondly in its strength. No deformation of the flame barrier is to be feared in the event of a pressure wave coming from an explosion acting on one of the faces of the device.

We claim:

1. A flame-barrier device (10) comprising: a plurality of openings (14) that are essentially parallel relative to a flow of a substance passing through the device, and an assembly of a plurality of pierced disks (12) include said openings (14) in alignment, said pierced disks (12) being stacked to form a bundle, wherein the openings (14) of the disks (12) come into alignment in such a manner as to co-operate with adjacent corresponding said openings (14) to form parallel through channels.

2. A flame-barrier device according to claim 1, wherein each said disk (12) includes the same number of said openings (14) organized in the same configuration.

3. A flame-barrier device according to claim 2, wherein the openings (14) are holes of the same diameter.

4. A flame-barrier device according to claim 2, wherein the openings (14) through the disks (12) are manufactured by drilling, stamping, forging, punching, or molding.

5. A flame-barrier device according to claim 2, wherein said opening (14) through a said disk (12) is accurately in alignment with an adjacent and corresponding opening of an adjacent said disk.

6. A flame-barrier device according to claim 2, wherein each said opening (14.1*a–e*) of a said disk (4.1*a–e*) is slightly offset relative to an adjacent and corresponding opening of an adjacent said disk.

7. A flame-barrier device according to claim 1, wherein at least one of the disks (12) is made of a metal.

8. A flame-barrier device according to claim 1, wherein at least one of the disks is made of a ceramic.

9. A flame-barrier device according to claim 1, wherein at least one of the disks (112X) is of a diameter greater than that of other said disks.

10. A flame-barrier device according to claim 1, wherein the disks (112) forming said device (110) are stacked on one another in a releasable manner.

11. A flame-barrier device according to claim 1, wherein the disks (12) forming said device (10) are fixed to one another by at least one of rivets (16) and studs (18).

12. A flame barrier device according to claim 1, wherein the disks (212) forming said device (210) are fixed together by a ring (20) which surrounds the assembly of the disks at a periphery of said disks.

* * * * *